US009551503B2

(12) United States Patent
Lee et al.

(10) Patent No.: US 9,551,503 B2
(45) Date of Patent: Jan. 24, 2017

(54) COMFORT CONTROL SYSTEM, USER-END SUBSYSTEM THEREOF, AND SYSTEM-END DEVICE THEREOF

(71) Applicant: INDUSTRIAL TECHNOLOGY RESEARCH INSTITUTE, Hsinchu (TW)

(72) Inventors: Hsin-Hung Lee, Miaoli County (TW); Chih-Chieh Li, Nantou County (TW); You-Yuan Jhong, Kaohsiung (TW); Jiunn-Haur Shaw, Taichung (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 297 days.

(21) Appl. No.: 13/889,906

(22) Filed: May 8, 2013

(65) Prior Publication Data

US 2014/0180480 A1 Jun. 26, 2014

(30) Foreign Application Priority Data

Dec. 20, 2012 (TW) ..... 101148706 A

(51) Int. Cl.
*F24F 11/06* (2006.01)
*F24F 11/00* (2006.01)

(52) U.S. Cl.
CPC ..... *F24F 11/006* (2013.01); *F24F 11/0009* (2013.01); *F24F 11/0034* (2013.01);
(Continued)

(58) Field of Classification Search
CPC ... F24F 11/0009; F24F 11/0034; F24F 11/006; F24F 2011/0061; F24F 2011/0068
(Continued)

(56) References Cited

U.S. PATENT DOCUMENTS 5,674,007 A 10/1997 Bu et al.
7,886,984 B2 2/2011 Tsai et al.
(Continued)

FOREIGN PATENT DOCUMENTS

CN 202036685 U 11/2011
TW I309343 B 5/2009
(Continued)

OTHER PUBLICATIONS

FindingBobbie, "I'm a Athlete", from <<http://www.sparkpeople.com/mypage_public_journal_individual.asp?blog_id=4047861>>, accessed Jul. 2, 2015.*
(Continued)

*Primary Examiner* — Kenneth M Lo
*Assistant Examiner* — Michael J Huntley
(74) *Attorney, Agent, or Firm* — Locke Lord LLP; Tim Tingkang Xia, Esq.

(57) ABSTRACT

A comfort control system includes a user-end subsystem and a system-end subsystem. The user-end subsystem includes an environmental control device, a sensor and a communication apparatus. The environmental control device adjusts an environmental factor value of a predetermined area. The sensor senses an activity value of a user. The communication apparatus sends the activity value and an identifier corresponding to the user. The system-end subsystem includes a communication element, a comfort database and a computing apparatus. The communication element receives the identifier and the activity value. The comfort database includes a basic data table having a physiological value and a preference data table having a control parameter. The computing apparatus looks up the basic data table for the physiological value and looks up the preference data table for a corresponding control parameter. The computing appa-
(Continued)

ratus controls the environmental control device to adjust the environmental factor value.

15 Claims, 1 Drawing Sheet

(52) U.S. Cl.
CPC ..... *F24F 2011/0036* (2013.01); *F24F 2011/0063* (2013.01); *F24F 2011/0064* (2013.01); *F24F 2011/0068* (2013.01); *F24F 2011/0069* (2013.01)

(58) Field of Classification Search
USPC ..... 700/275
See application file for complete search history.

(56) References Cited

U.S. PATENT DOCUMENTS

| | | | | |
|---|---|---|---|---|
| 8,140,191 | B2 * | 3/2012 | Kanai et al. | 700/276 |
| 8,630,741 | B1 * | 1/2014 | Matsuoka | H04L 12/2829 700/12 |
| 2004/0065098 | A1 * | 4/2004 | Choi et al. | 62/180 |
| 2006/0072507 | A1 * | 4/2006 | Chandra | H04W 36/245 370/332 |
| 2007/0100666 | A1 * | 5/2007 | Stivoric et al. | 705/3 |
| 2009/0065596 | A1 * | 3/2009 | Seem et al. | 236/51 |
| 2009/0159717 | A1 | 6/2009 | Tsai et al. | |
| 2011/0290893 | A1 * | 12/2011 | Steinberg | 236/49.3 |

FOREIGN PATENT DOCUMENTS

| | | |
|---|---|---|
| TW | 201032773 | 9/2010 |
| TW | 201118626 A | 6/2011 |
| TW | 201133361 | 10/2011 |
| TW | 201212885 | 4/2012 |
| TW | 201217926 A | 5/2012 |
| TW | 201237675 A | 9/2012 |

OTHER PUBLICATIONS

Homod, et al., RLF and TS fuzzy model identification of indoor thermal comfort based on PMV/PPD, 2012, pp. 141-153, Building and Environment 49 (2012).

Bermejo, et al.,Design and simulation of a thermal comfort adaptive system based on fuzzy logic and on-line learning, 2012, pp. 367-379, Energy and Buildings 49 (2012).

Brage, et al., Branched equation modeling of simultaneous accelerometry and heart rate monitoring improves estimate of directly measured physical activity energy expenditure, 2004, pp. 343-351, J Appl Physiol 96.

Choi, et al., Investigation of the possibility of the use of heart rate as a human factor for thermal sensation models, 2012, pp. 165-175, Building and Environment 50 (2012).

Duan, et al., A Novel Data-based Control Strategy of Dynamic Thermal Comfort for Inhabited Environment, 2010, pp. 4865-4869, Intelligent Control and Automation (WCICA), 2010 8th World Congress.

Guo, et al.,Technologies toward Thermal Comfort-based and Energy-efficient HVAC Systems: A Review, 2009, pp. 3883-3888, Systems, Man and Cybernetics, 2009. SMC 2009. IEEE International Conference.

Intellectual Property Office, Ministry of Economic Affairs, R.O.C., "Office Action", Jan. 28, 2015, Taiwan.

* cited by examiner

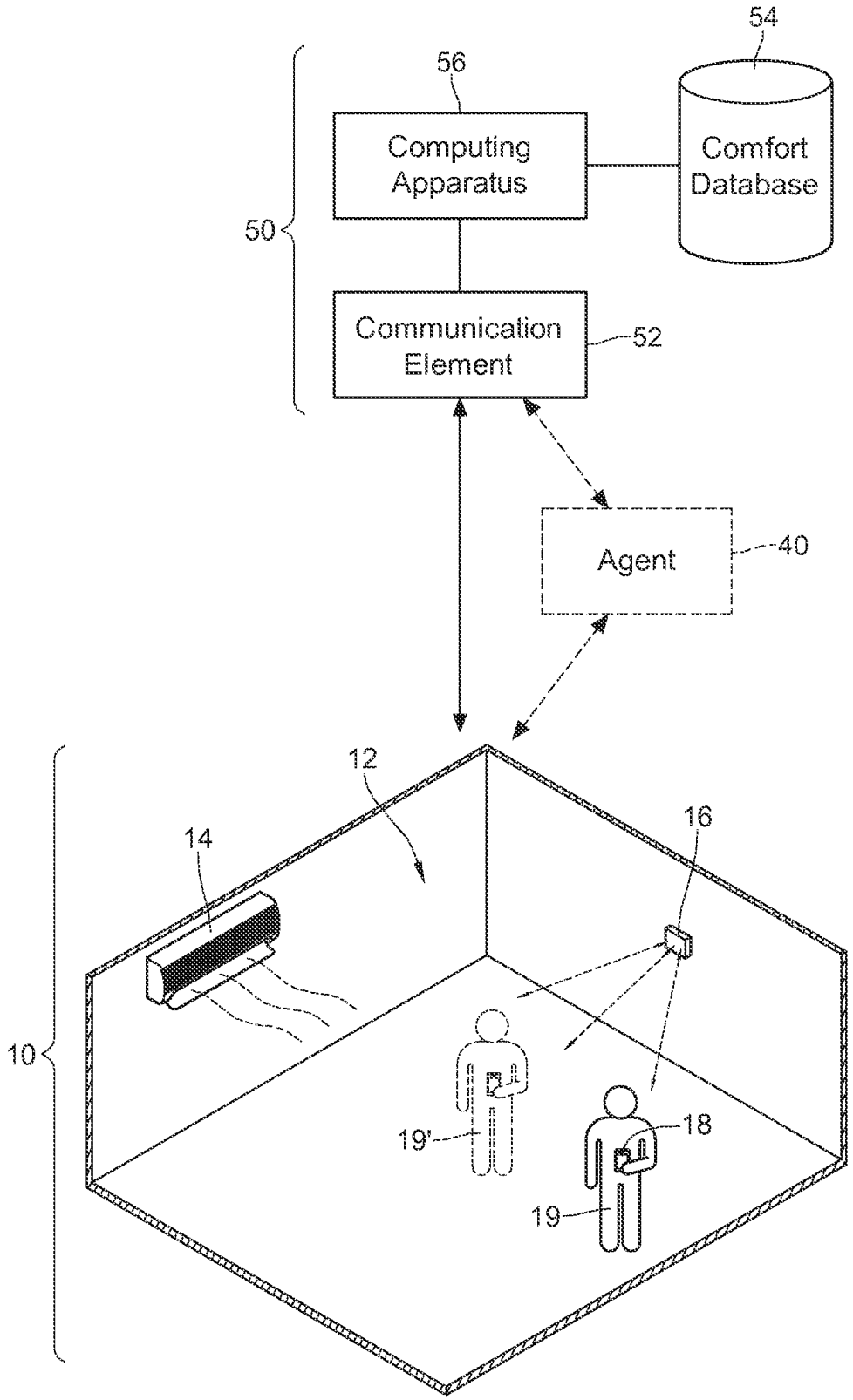
54
56
Computing Apparatus
Comfort Database
50
Communication Element
52
Agent
40
12
14
16
10
19'
18
19

COMFORT CONTROL SYSTEM, USER-END SUBSYSTEM THEREOF, AND SYSTEM-END DEVICE THEREOF

CROSS-REFERENCE TO RELATED APPLICATIONS

This non-provisional application claims priority under 35 U.S.C. §119(a) on Patent Application No(s). 101148706 filed in Taiwan, R.O.C. on Dec. 20, 2012, the entire contents of which are hereby incorporated by reference.

TECHNICAL FIELD

The disclosure relates to a comfort control system.

BACKGROUND

As the environment and climate change, the issue of human living comfort becomes more and more popular. Common devices for adjusting ambient comfort are an air cooler and an air heater. For general operation of the air cooler and the air heater, usually a user sets a temperature, then the air cooler or the air heater adjusts the temperature in a corresponding indoor space according to a control mechanism, so that the indoor temperature is kept around the set temperature.

Secondly, in order to prevent the environment from being continuously damaged, governments and the industry all expect that most basic comfort requirements are met with the least power consumption. Therefore, the industry continuously develops a proper method for controlling the air cooler and the air heater, and proposes a corresponding energy-saving system.

Some technologies provide a method using an air conditioning device to control an ambient thermal comfort level, which are also technologies for addressing the aforementioned issue.

SUMMARY

An embodiment of the disclosure provides a comfort control system comprising a user-end subsystem and a system-end subsystem. The user-end subsystem comprises an environmental control device, a sensor and a communication apparatus. The environmental control device is disposed in a predetermined area. The environmental control device is adapted for adjusting an environmental factor value of the predetermined area when the environmental control device is controlled. The sensor is adapted for sensing an activity value of a user in the predetermined area. The communication apparatus is located in the predetermined area. The communication apparatus is adapted for sending the activity value and an identifier corresponding to the user. The system-end subsystem comprises a communication element, a comfort database and a computing apparatus. The communication element is adapted for receiving the identifier and the activity value. The comfort database comprises a basic data table and a preference data table. The basic data table has at least one physiological value corresponding to the identifier. The preference data table comprises at least one control parameter corresponding to the identifier, the activity value, the physiological value and the predetermined area. The computing apparatus is adapted for looking up the basic data table for the physiological value corresponding to the identifier which is received. The computing apparatus is adapted for looking up the preference data table for a corresponding control parameter according to the activity value, the physiological value, the identifier and the predetermined area. The computing apparatus is adapted for controlling the environmental control device through the communication element and the communication apparatus according to the control parameter, so as to adjust the environmental factor value.

Another embodiment of the disclosure provides a comfort control system, comprising a user-end subsystem and a system-end subsystem. The user-end subsystem comprises an environmental control device, a sensor and a communication apparatus. The environmental control device is disposed in a predetermined area and is adapted for adjusting an environmental factor value of the predetermined area when the environmental control device is controlled. The sensor is adapted for sensing a plurality of activity values of a plurality of users in the predetermined area. The communication apparatus is located in the predetermined area. The communication apparatus is adapted for sending the plurality of activity values and a plurality of identifiers corresponding to the users. The system-end subsystem comprises a communication element, a comfort database and a computing apparatus. The communication element is adapted for receiving the plurality of identifiers and the plurality of activity values. The comfort database comprises a basic data table and a preference data table. The basic data table has a plurality of physiological values corresponding to the plurality of identifiers. The preference data table comprises a plurality of control parameters corresponding to the plurality of identifiers, the plurality of activity values, the plurality of physiological values and the predetermined area. The computing apparatus is adapted for looking up the basic data table for the physiological values corresponding to the received identifiers. The computing apparatus is adapted for looking up the preference data table for the corresponding control parameters according to the activity values, the physiological values, the identifiers and the predetermined area. The computing apparatus is adapted for modulating the control parameters according to a modulating mechanism to obtain a modulated parameter. The computing apparatus is also adapted for controlling the environmental control device through the communication element and the communication apparatus according to the modulated parameter, so as to adjust the environmental factor value.

Yet another embodiment of the disclosure provides a user-end subsystem of a comfort control system which comprises a sensor, a communication apparatus and an environmental control device. The sensor is adapted for sensing an activity value of a user in a predetermined area. The communication apparatus, located in the predetermined area, is adapted for sending the activity value and an identifier corresponding to the user and for receiving a control parameter. The environmental control device, disposed in the predetermined area, is adapted for adjusting an environmental factor value of the predetermined area according to the control parameter.

Still another embodiment of the disclosure provides a system-end subsystem of a comfort control system which comprises a communication element, a comfort database and a computing apparatus. The communication element is adapted for receiving an identifier and an activity value. The comfort database comprises a basic data table and a preference data table. The basic data table has at least one physiological value corresponding to the identifier. The preference data table comprises at least one control parameter corresponding to the identifier, the activity value, the physiological value and a predetermined area. The computing apparatus is adapted for looking up the basic data table for the physiological value corresponding to the received identifier. The computing apparatus is also adapted for looking up the preference data table for the corresponding control parameter according to the activity value, the physiological value, the identifier and the predetermined area. The computing apparatus is adapted for controlling an environmental control device through the communication element according to the control parameter, so as to adjust an environmental factor value of the predetermined area.

BRIEF DESCRIPTION OF THE DRAWING

The disclosure will become more fully understood from the detailed description given herein below for illustration only, thus does not limit the disclosure, wherein:

The FIGURE is a schematic view of a comfort control system according to an embodiment of the disclosure.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring to the FIGURE, which is a schematic view of a comfort control system according to an embodiment of the disclosure. It can be seen from the drawing that the comfort control system comprises a user-end subsystem 10 and a system-end subsystem 50.

In this embodiment and some other embodiments, the user-end subsystem 10 is disposed in any predetermined area 12 or predetermined space. In this embodiment and some other embodiments, the predetermined area 12 is a separate room, an office area, or an area where a comfort level is to be controlled.

In this embodiment and some other embodiments, the system-end device 50 is disposed in a same position as the user-end subsystem 10 is disposed. For example, the system-end device 50 is disposed in the predetermined area 12. Alternatively, in other embodiments, the system-end device 50 is disposed remotely, for example, in a cloud computing area, but is not limited to the disclosure.

The user-end subsystem 10 comprises an environmental control device 14, a sensor 16, and a communication apparatus 18. When being controlled, the environmental control device 14 is adapted for adjusting an environmental factor value of the predetermined area 12. In this and some other embodiments, the environmental control device 14 is any device capable of being used for controlling comfort. For example, the environmental control device 14 is an air cooler, an air heater, an air conditioner, a humidifier, a dehumidifier, a fan, and a lighting device, but is not limited to the disclosure. The environmental factor value is a comfort level controlled by the environmental control device 14. For example, in this and some other embodiments, when the environmental control device 14 is an air cooler, an air heater, or an air conditioner, the environmental factor value is a temperature. When the environmental control device 14 is a humidifier or a dehumidifier, the environmental factor value is humidity. When the environmental control device 14 is a fan, the environmental factor value is an air speed or an air volume. When the environmental control device 14 is a lighting device, the environmental factor value is illuminance (lux) or a luminous flux (lumen).

The sensor 16 is adapted for sensing an activity value of a user 19 and/or an environmental parameter. In this and some other embodiments, the activity value is heartbeat (i.e., a heart-beat rate or a heart rate) and/or a body surface temperature and/or a respiratory rate, that is, the heartbeat, the body surface temperature, the respiratory rate or a combination thereof, but is not limited to the disclosure. Herein, "a combination thereof" refers to any combination of the heartbeat, the body surface temperature, and the respiratory rate, that is, a combination of any two or three of the above-mentioned. The "a combination thereof" in the following has the same meaning, and refers to a combination formed of one or more than one of the preceding elements. In this and some other embodiments, the sensor 16 is a contact sensor or a non-contact sensor, for example, a Doppler radar, an ultra wideband sensing module, a passive infrared/three-dimension (PIR/3D) depth measuring apparatus, but is not limited to the disclosure. The heart-beat rate indicates whether the user 19 in the predetermined area is in an anxious or a movement state. When the heart-beat rate is high, it possibly indicates that the intensity of cooling needs to be increased to make the user comfortable. In this and some other embodiments, the body surface temperature is obtained through a contact or a non-contact temperature sensing element. In this and some other embodiments, the sensor 16 is a sensor built in a mobile phone. In this and some other embodiments, the environmental parameter is information such as the temperature, the humidity, and the air speed in the predetermined area 12. In this and some other embodiments, the sensor 16 is a sensing element group, which senses the activity value (such as the heartbeat) and the environmental parameter (such as the temperature in the predetermined area 12) at the same time.

The communication apparatus 18 is adapted for sending the activity value and an identifier that corresponds to the user 19. In this and some other embodiments, the communication apparatus 18 is any communication device, for example, a mobile phone, a network card, and a Bluetooth® device, but is not limited to the disclosure. In this and some other embodiments, the identifier is an identity identification number of the user 19, a mobile phone number, or a subscriber identity module (SIM) number of a mobile phone, but is not limited to the disclosure. The communication apparatus 18 is used by the user-end subsystem 10 to communicate with the system-end device 50. In this and some other embodiments, the communication apparatus 18 is adapted for collecting the activity value sensed by the sensor 16 and the identifier, and then for sending the activity value and the identifier. When the communication apparatus 18 is a mobile phone, the activity value, sensed by the sensor 16, is sent by another communication unit. The communication apparatus 18 herein is not limited to a single communication unit. In other embodiments, the communication apparatus 18 is a plurality of communication units.

In this embodiment, the communication apparatus 18 is a mobile phone, but the disclosure is not limited thereto. In this and some other embodiments, during implementation, the communication apparatus 18 adopts a network card or a wireless communication device. After the user inputs their personal identification data thereof (such as an identity card number), the communication apparatus 18 sends the identification data which is taken as the identifier, and the identification data is received by the system-end device.

The system-end device 50 comprises a communication element 52, a comfort database 54, and a computing apparatus 56.

The communication element 52 is an adapter for receiving the identifier and the activity value sent by the communication apparatus 18.

The comfort database 54 comprises a basic data table and a preference data table. The basic data table has at least one physiological value corresponding to the identifier. The preference data table comprises at least one control parameter corresponding to the identifier, the activity value, the physiological value, and the predetermined area 12.

The basic data table stores the plurality of identifiers and the plurality of physiological values corresponding to the identifiers. Each identifier corresponds to the single user 19 that subscribes to a service of the comfort control system of the disclosure. In this and some other embodiments, the physiological value is basic physiological data of each user 19 that is selected from a group consisting of age, height, weight, gender, and a Basal Metabolic Rate (BMR), that is, the basic physiological data is the age, the height, the weight, the gender, the BMR or a combination thereof, but is not limited to the disclosure.

The preference data table stores a plurality of control parameters. Each group of the plurality of control parameters is set according to a preferred comfort level of each user. In this and some other embodiments, the control parameter is a specific temperature (for example, 26 degrees Celsius), a specific humidity (for example, 40%), a specific air volume, a specific air speed, a specific illuminance (for example, 80 lux), but is not limited to the disclosure. Furthermore, in this and some other embodiments, for different areas, the preference data table has different control parameters. For example, in this and some other embodiments, the control parameter of the user 19 in Taiwan is different from the control parameter of the same user 19 in Thailand, because the control parameter is fine tuned according to features of different areas and characteristics of the user 19. For example, when a user having lived in Iceland for a long time goes to Thailand, the preference data table thereof is different from the preference data table of a user, who has lived in Africa for a long time, when arriving in Thailand. Although the two persons are the same in body type, gender, and the BMR, preference data tables of the two persons are different from each other. In other words, the establishment of the preference data table needs to take into account of national geographic factors, the latitude, and physical factors. Furthermore, in this and some other embodiments, for different seasons, the preference data table has different control parameters. For example, for a same physiological value of the same user 19, corresponding control parameters in different seasons are different. Moreover, in this and some other embodiments, for different predetermined areas 12, the preference data tables are also different. For example, when the predetermined area 12 is an operating room in a hospital, the room temperature thereof is usually lower than that of a general medical ward in the same hospital. For another example, when the predetermined areas 12 are areas such as an intensive care unit and a gym, the preference data tables thereof are extremely different accordingly.

The computing apparatus 56 is adapted for looking up the basic data table for the physiological value corresponding to the identifier which is received. Then, the computing apparatus 56 is adapted for looking up the preference data table for a corresponding control parameter according to the activity value, the physiological value, the identifier, and the predetermined area 12. The computing apparatus 56 is adapted for controlling the environmental control device 14 through the communication element 52 and the communication apparatus 18 according to the control parameter, so as to adjust the environmental factor value.

In this and some other embodiments, contents of the preference data table have several modes. In one mode, the preference data table stores a control parameter corresponding to a specific activity value, a specific physiological value, a specific identifier and a specific predetermined area 12. In this mode, the computing apparatus 56 is adapted for looking up the preference data table for the corresponding control parameter based on the activity value, the physiological value, the identifier and the predetermined area 12.

In another mode, the computing apparatus 56 is adapted for integrating the activity value, the physiological value and the identifier to obtain an energy expenditure (EE) parameter. The integration manner is the following manner, but not limited to the disclosure.

The computing apparatus 56 first calculates a BMR according to gender, weight, height, and age, and formulas for the calculation are different for the male and the female. For example, for a female, the BMR=655+(9.6×weight (kg))+(1.85×height (m))−(4.7×age); for a male, the BMR=66.5+(13.8×weight (kg))+(5.0×height (m))−(6.8×age).

Then, the computing apparatus 56 calculates the EE parameter which equals $BMR+21.75/(1+e^{8.88-0.095\times HR})$.

The preference data table has a control parameter corresponding to the predetermined area and the EE parameter, so that the computing apparatus 56 looks up the preference data table for the corresponding control parameter according to the EE parameter which is calculated.

In this and some other embodiments, as obtaining the control parameter, the computing apparatus 56 controls the environmental control device 14 through the communication element 52 and the communication apparatus 18 according to the control parameter, so as to adjust the environmental factor value. When the predetermined area 12 has a plurality of environmental control devices 14, the control parameter comprises individual parameters corresponding to the plurality of environmental control devices 14.

When a single system-end device 50 corresponds to a plurality of user-end subsystems 10, in this and some other embodiments, an agent 40 is further added between the system-end device 50 and the user-end subsystem 10. In this and some other embodiments, the agent 40 is disposed at the system-end device 50 or at the user-end subsystem 10 according to actual requirements. The agent 40 controls the environmental control device 14 in the user-end subsystem 10 in real time according to the control parameter from the computing apparatus 56, so as to reduce the burden on the computing apparatus 56.

Furthermore, when two users 19 and 19' exist in the single predetermined area 12, the sensor 16 is adapted for sensing a plurality of activity values of the two users 19 and 19' located in the predetermined area 12. The communication apparatus 18, located in the predetermined area, is adapted for sending the activity values and a plurality of identifiers corresponding to the users 19 and 19'. The communication element 52 is adapted for receiving the identifiers and the activity values.

The comfort database 54 comprises the basic data table and the preference data table. The basic data table has a plurality of physiological values corresponding to the identifiers. The preference data table comprises a plurality of control parameters corresponding to the identifiers, the activity values, the physiological values, and the predetermined area.

The computing apparatus 56 is adapted for looking up the basic data table for the physiological values corresponding to the received identifiers. The computing apparatus 56 is adapted for looking up the preference data table for the corresponding control parameters according to the activity values, the physiological values, the identifiers, and the predetermined area 12. The computing apparatus 56 is adapted for modulating the control parameters according to a modulating mechanism to obtain a modulated parameter as well as controlling the environmental control device 14 through the communication element 52 and the communication apparatus 18 according to the modulated parameter, so as to adjust the environmental factor value.

In this and some other embodiments, the modulating mechanism adopts the mean or mode of the control parameters of all the users 19 and 19' in the specific area 12. In this and some other embodiments, the above-mentioned modulating mechanism is adapted for providing the users 19 and 19' with different weighting factors. For example, a parameter for setting the weighting factor is the distance to the environmental control device 14, or the weighting factor is determined according to the property of the user (for example, the age or the rank). If a plurality of environmental control devices 14 exists, the users 19 and 19' closer to each environmental control device 14 have greater weighting factors, and the users 19 and 19' farther away from each environmental control device 14 have smaller weighting factors. Furthermore, in other embodiments, the modulating mechanism may only adopt a greatest control parameter or a smallest control parameter.

Moreover, in this and some other embodiments, the preference data table is established according to questionnaires, empirical values, or experiments, or established by learning. For example, in this and some other embodiments, an initial preference data table is formed of statistical values of each country or each area, the statistical values comprise data with various physiological values, EEs, and corresponding comfort requirements.

Then, when the comfort control system of the disclosure is in operation, and the users 19 and 19' control the environmental control device 14, in this and some other embodiments, the environmental control device 14 is adapted for uploading user control data through a communication module built in the communication apparatus 18 or the environmental control device 14. As receiving the control data, the computing apparatus 56 is adapted for updating a comfort data table through determination or calculation, so that the control parameter of the users 19 and 19' is capable of being updated to the latest situation.

Finally, in this and some other embodiments, the control parameter preferred by the users 19 and 19' is a target control parameter of the predetermined area 12. For example, when the identifier of the users 19 and 19' is a code of a predetermined area 12 and the predetermined area 12 is an agricultural greenhouse, the system-end device 50 in the cloud computing area is adapted for controlling the environmental control device 14 of the user-end subsystem 10, so as to achieve proper greenhouse control.

In view of the above, through the comfort control system of the disclosure, the setting is performed according to the activity value (that is a current activity state) of the user in the predetermined space, the physiological value, and the comfort preferred by the user, so as to control the environmental control device in the predetermined space, so that the predetermined space is capable of keeping the comfort preferred by the users.

What is claimed is:

1. A comfort control system, comprising:

a user-end subsystem comprising:

an environmental control device disposed in a predetermined area and for adjusting an environmental factor value of the predetermined area when being controlled;

a sensor for sensing a plurality of activity values of a plurality of users in the predetermined area; and a communication apparatus located in the predetermined area and for sending the plurality of activity values and a plurality of identifiers corresponding to the users; and a system-end subsystem comprising:

a communication element for receiving the plurality of identifiers and the plurality of activity values;

a comfort database comprising a basic data table and a plurality of preference data tables, the basic data table having a plurality of physiological values corresponding to the plurality of identifiers, each of the plurality of preference data tables comprising a plurality of control parameters corresponding to one of the plurality of identifiers, one of the plurality of activity values, one of the plurality of physiological values and the predetermined area; and a computing apparatus for looking up the basic data table for the physiological values corresponding to the received identifiers, the computing apparatus adapted for looking up the plurality of preference data tables for the corresponding control parameters according to the activity values, the physiological values, the identifiers and the predetermined area, and wherein the computing apparatus is adapted for modulating the control parameters according to a modulating mechanism to obtain a modulated parameter, and for controlling the environmental control device through the communication element and the communication apparatus according to the modulated parameter, so as to adjust the environmental factor value, wherein each of the plurality of users is corresponding to one of a plurality of different environment controlling weighting values, each of the plurality of different environment controlling weighting values is negatively correlated with a distance between the corresponding user and the environmental control device, and the modulating mechanism obtains the modulated parameter according to the plurality of different environment controlling weighting values.

2. The comfort control system according to claim 1, wherein the environmental control device is an air cooler, a heater, an air conditioner, a humidifier, a dehumidifier, a fan, a lighting device or a combination thereof.

3. The comfort control system according to claim 2, wherein the environmental factor value is a temperature, humidity, an air speed, thermal radiation, illuminance or a combination thereof.

4. The comfort control system according to claim 1, wherein the communication apparatus is a mobile phone, and the identifier is a mobile phone number or a SIM number of the mobile phone.

5. The comfort control system according to claim 1, wherein the activity value is a heart-beat rate, a body surface temperature, a respiratory rate or a combination thereof.

6. The comfort control system according to claim 1, wherein the physiological value is age, height, weight, gender, a basal metabolic rate (BMR) or a combination thereof.

7. The comfort control system according to claim 1, wherein the sensor is a contact sensor or a non-contact sensor.

8. The comfort control system according to claim 1, wherein the modulating mechanism obtains the mean or the mode of the control parameters, so as to obtain the modulated parameter.

9. A user-end subsystem of a comfort control system, comprising:

a sensor for sensing a plurality of activity values of a plurality of users in a predetermined area;

a communication apparatus, located in the predetermined area, and wherein the communication apparatus is adapted for sending the plurality of activity values and a plurality of identifiers corresponding to the users and for receiving a plurality of control parameters; and an environmental control device disposed in the predetermined area and for adjusting an environmental factor value of the predetermined area according to the plurality of control parameters, wherein the environmental factor value is adjusted according to a modulated parameter, the modulated parameter is obtained according to a modulating mechanism by modulating the plurality of control parameters; and wherein each of the plurality of users is corresponding to one of a plurality of different environment controlling weighting values, each of the plurality of different environment controlling weighting values is negatively correlated with a distance between the corresponding user and the environmental control device, and the modulating mechanism obtains the modulated parameter according to the plurality of different environment controlling weighting values.

10. The user-end subsystem according to claim 9, wherein the environmental control device is an air cooler, a heater, an air conditioner, a humidifier, a dehumidifier, a fan, a lighting device or a combination thereof.

11. The user-end subsystem according to claim 10, wherein the environmental factor value is a temperature, humidity, an air speed, thermal radiation, illuminance or a combination thereof.

12. The user-end subsystem according to claim 9, wherein the communication apparatus is a mobile phone, and the identifier is a mobile phone number or a SIM number of the mobile phone.

13. The user-end subsystem according to claim 9, wherein the activity value is a heart-beat rate, a body surface temperature, a respiratory rate or a combination thereof.

14. The user-end subsystem according to claim 9, wherein the sensor is a contact sensor or a non-contact sensor.

15. A system-end subsystem of a comfort control system, comprising:

a communication element for receiving a plurality of identifiers corresponding to a plurality of users and a plurality of activity values of the users;

a comfort database comprising a basic data table and a plurality of preference data tables, the basic data table having a plurality of physiological values corresponding to the plurality of identifiers, and each of the plurality of preference data tables comprising a plurality of control parameters corresponding to one of the plurality of identifiers, one of the plurality of activity values, one of the physiological values and a predetermined area; and a computing apparatus for looking up the basic data table for the physiological values corresponding to the received identifiers, the computing apparatus adapted for looking up the preference data tables for the corresponding control parameters according to the activity values, the physiological values, the identifiers and the predetermined area, and wherein the computing apparatus is adapted for controlling an environmental control device through the communication element according to the control parameters, so as to adjust an environmental factor value of the predetermined area, wherein the environmental factor value is adjusted according to a modulated parameter, the modulated parameter is obtained according to a modulating mechanism by modulating the plurality of control parameters; and wherein each of the plurality of users is corresponding to one of a plurality of different environment controlling weighting values, each of the plurality of different environment controlling weighting values is negatively correlated with a distance between the corresponding user and the environmental control device, and the modulating mechanism obtains the modulated parameter according to the plurality of different environment controlling weighting values.

* * * * *